US005773077A

United States Patent [19]

Edmond

[11] Patent Number: 5,773,077

[45] Date of Patent: Jun. 30, 1998

[54] ABRASION-PROTECTIVE CONVERTIBLE WINDOW

[75] Inventor: Stanley Edmond, Woodland Hills, Calif.

[73] Assignee: Ellay, Inc., Los Angeles, Calif.

[21] Appl. No.: 544,401

[22] Filed: Oct. 10, 1995

[51] Int. Cl.[6] ..... B05D 3/10; B05D 7/24

[52] U.S. Cl. ..... 427/155; 427/209; 427/163.1; 427/393.5

[58] Field of Search ..... 427/155, 163.1, 427/209, 393.5, 322, 154; 296/146.14; 428/34, 441, 442, 336

[56] References Cited

U.S. PATENT DOCUMENTS 2,487,255 11/1949 Mahoney ..... 427/154
3,914,469 10/1975 Delano et al. ..... 427/164
4,013,607 3/1977 Dwyer et al. ..... 524/428
5,143,949 9/1992 Grogan et al. ..... 427/154

*Primary Examiner*—Paul J. Thibodeau
*Assistant Examiner*—D. Lawrence Tarazano
*Attorney, Agent, or Firm*—Christie, Parker & Hale, LLP

[57] ABSTRACT

A window for use in a convertible top comprises a thin, flexible, optically transparent plastic sheet and a thin, flexible, optically transparent thermoplastic abrasion-protective coating applied to both faces of the plastic sheet. The abrasion-protective coating comprises a weatherable polymer such as an acrylic polymer which is transparent in thin film form and adhered to the plastic sheet as a semi-permanent coating removable by an alkaline water-based cleaning agent. The thin-film form coating provides a level of abrasion protection by preferentially abrading while protecting the underlying clear plastic window from scratching. A preferred coating comprises a water-based emulsion of an acrylic polymer such as an acrylic floor polish diluted with water and applied to the window by a dipping process.

6 Claims, 1 Drawing Sheet

ABRASION-PROTECTIVE CONVERTIBLE WINDOW

FIELD OF THE INVENTION

This invention relates to windows for convertible tops, and more particularly, to a process for making a clear plastic convertible window which is protected against abrasion damage throughout the process of manufacturing the window and installing it in the convertible top.

BACKGROUND OF THE INVENTION

Convertible tops for automobiles, boats and other recreational vehicles are characterized by their familiar foldable top which is made of nylon or other rugged waterproof, flexible material. The top has an optically clear window that is commonly made from a flexible plastic material that withstands folding. Clear plastic convertible windows are commonly made from optically transparent sheets of polyvinyl chloride (PVC) which are desirable because of their needed flexibility and weatherability, but such flexible thermoplastic PVC sheets do not have a high level of resistance to abrasion damage. In fact, scratching of convertible windows is a major problem confronted by those involved at various levels in the business of manufacturing, transporting and installing flexible clear plastic windows in convertible tops.

Clear plastic convertible windows are checked for defects throughout the production and installation process. The end user demands a perfect scratch-fee window and OEM rejection rates are high, costing substantial monetary losses in both labor and materials.

The current process of manufacturing a clear plastic convertible window involves forming transparent sheets of PVC to a specified size and a uniform sheet thickness, and placing the finished sheets in a stack of predetermined height in which the sheets in the stack are separated by sheets of paper. The stacks of separated PVC sheets are then rolled up, placed in box-like containers, and shipped to the convertible top manufacturer. At the top manufacturing site the PVC sheets are manually removed from the stack and hand sewn or radio frequency welded into the convertible top. Although any step in the manufacturing process can be susceptible to causing scratching of the clear plastic window, most scratching occurs either during installation of the window in the top, or in shipment from the auto manufacturer to the dealer.

The present invention provides an improvement in the window manufacturing process which greatly reduces scratching and other abrasion defects which may occur to the window during manufacturing, shipment to the installation site, installation of the window in the convertible top, and shipment of the finished product to the dealer. The invention also protects against scratching during use by the auto purchaser. As a result of the invention, OEM rejections can be greatly reduced, along with providing considerable savings in the cost of labor and materials.

SUMMARY OF THE INVENTION

Briefly, one embodiment the present invention comprises a window for use in a vehicular convertible top comprising a thin, flexible, optically transparent plastic sheet, and a thin, flexible, optically transparent abrasion-protective coating applied in dry thin-film form to opposite faces of the plastic sheet. The abrasion-protective coating comprises a weatherable polymer which in thin-film form is adhered to the plastic sheet as a semi-permanent coating removable by an alkaline water-based cleaning agent. The coating in its thin-film form provides a useful level of abrasion protection by preferentially scratching while protecting the underlying window from such abrasion damage.

In one form of the invention, the abrasion-protective coating comprises a water-based emulsion containing an acrylic polymer. Surprisingly, an acrylic floor polish for no-wax floors provides exceptional results as an abrasion-protective transparent coating for convertible windows.

In another embodiment of the invention, the abrasion-protective window is installed in a convertible top by the convertible top manufacturer. The abrasion-protective transparent coating remains intact on opposite faces of the window until the automobile is delivered to the purchaser. The coating can be removed and re-applied to continue providing its useful level of abrasion protection and transparency during use.

Thus, the abrasion-protective coating applied to both faces of the window is available to preferentially absorb abrasion damage throughout the process of (1) manufacturing the window, (2) stacking the completed windows, (3) shipping the windows to the installation site, (4) installation of the window in the convertible top, (5) shipment to the auto manufacturer, (6) installation of the top in the automobile, and (7) delivery of the automobile to the auto dealer and ultimately to the end-user. The availability of the protective coating on both sides of the window throughout this process greatly reduces the chances of defects in the finished window.

These and other aspects of the invention will be more fully understood by referring to the following detailed description and the accompany drawings.

DETAILED DESCRIPTION

Figure 1:
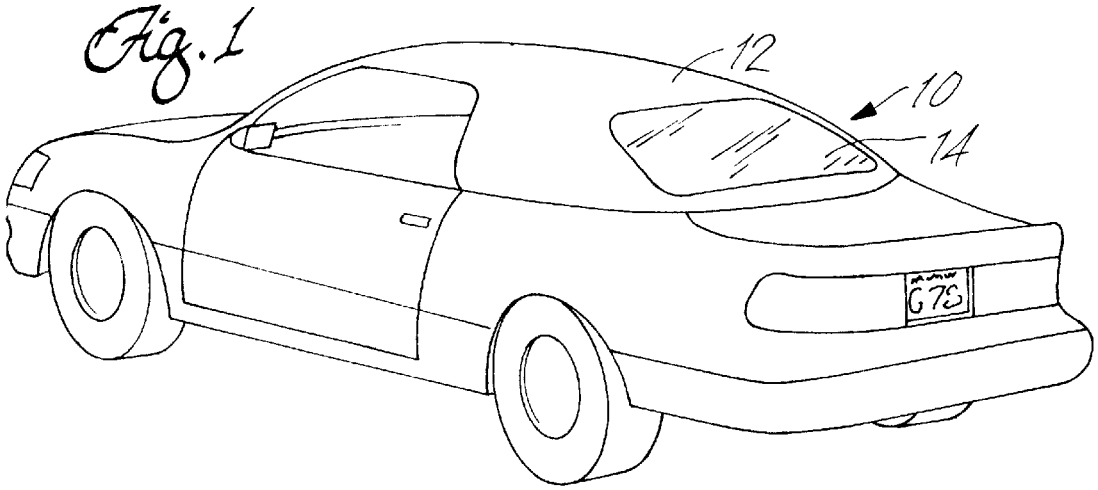
FIG. 1 is a perspective view showing an automobile with a convertible top having an abrasion-protective window made according to principles of this invention.

Referring to FIG. 1, an automobile 10 has a convertible top 12 with a flexible, optically clear plastic rear convertible window 14. The automobile convertible top of FIG. 1 illustrates a typical use of the invention which can also be used in clear plastic windows of convertible tops for boats or other recreational vehicles.

Figure 3:
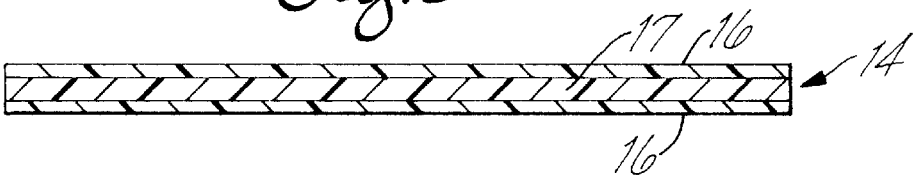
FIG. 3 is a schematic block diagram illustrating a progression of steps in the process of manufacturing the convertible window, transporting it to the convertible top manufacturer, installation of the convertible window, and shipment of the completed top to an auto assembly plant and ultimately to the end purchaser of the vehicle.
Figure 2:
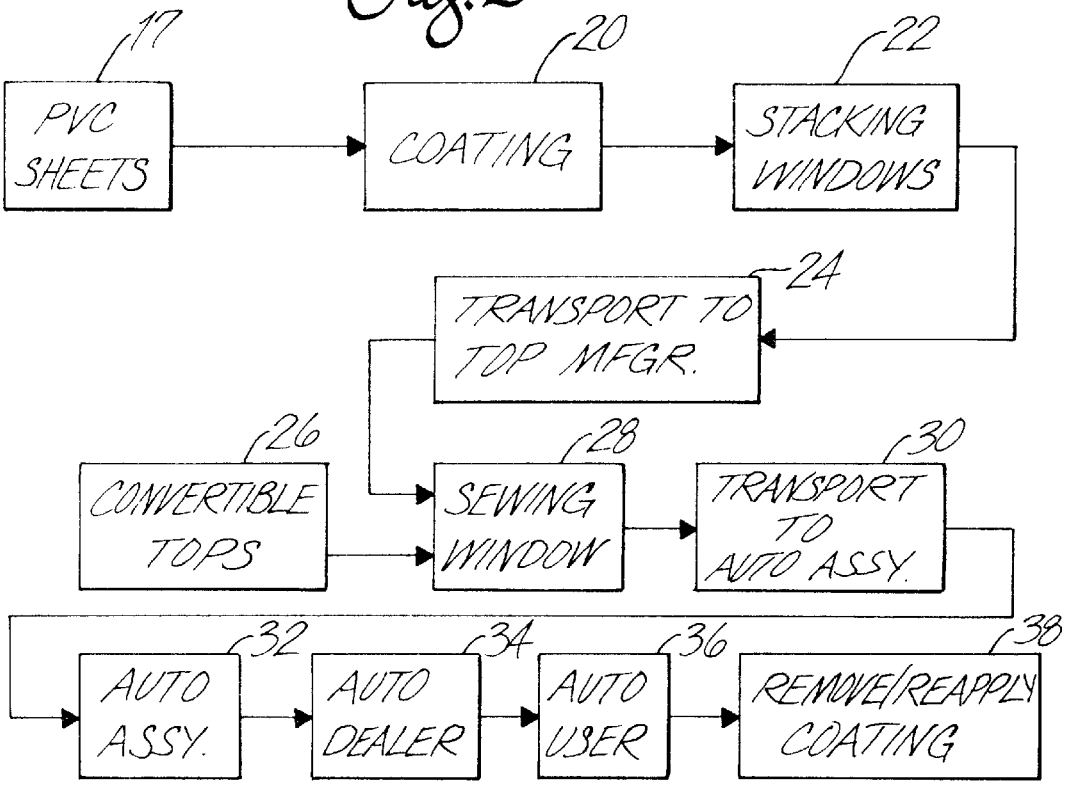
FIG. 2 is a schematic cross-sectional illustration of the convertible window of this invention.

FIG. 2 schematically illustrates the present invention which involves applying an optically clear, flexible, abrasion-protective coating 16 to opposite sides of a clear plastic sheet 17 of a convertible window material such as PVC. The coating 16 is applied during the manufacturing process, the steps of which are illustrated in FIG. 3. The composition of the coating 16 and examples of its preparation and use are described in detail below. FIG. 3 also illustrates the steps in the process of installing the convertible window in the convertible top as well as illustrating other steps in the use of the window in the convertible top after it leaves the manufacturer.

Referring to FIG. 3, the starting material for the convertible window comprises sheets of a flexible, weatherable, clear plastic convertible window material. A presently preferred material, as mentioned previously, is polyvinyl chloride or other polymer blend principally containing polyvinyl chloride. The transparent sheets of PVC 17 are formed in a specified size and of a desired sheet thickness. Such plastic windows in their finished form typically are made with a sheet thickness from about 20 to about 40 mils. The sheets are then sent to a coating station 20 where the coating 16 is applied to both faces of each transparent PVC sheet. One method of applying the coating is by dipping the sheets into a large vessel containing a liquid coating material. The coating also may be applied by spraying. The dipping or spray process is followed by air drying the coating to form a dried flexible optically transparent and abrasion-protective film on opposite faces of the PVC sheet.

In the process of dipping the sheets in the liquid coating, drying can be enhanced by first using an air knife to remove excess coating material from the coated sheets. Oven drying also can be used to speed the drying process, if necessary. In one embodiment, drying is carried out at about 150° F. with moderate air velocity applied to the coatings on the opposite faces of the clear plastic sheets.

After the coated window 14 is thoroughly dried, each window is stacked at a stacking station 22 where the stacks of sheets of a predetermined height are then placed in containers and transported to the convertible top manufacturer in a step 24.

At the convertible top manufacturing plant the starting material comprises conventional convertible tops 26 made from the familiar flexible convertible top material such as nylon or other similar flexible weatherable waterproof fabric. The coated convertible windows 14 are hand sewn around the periphery to the convertible top opening to form a completed convertible window installed in the top. The completed convertible top is then transported to the auto assembly plant at a step 30. At the auto assembly plant 32 the convertible top is installed in the conventional folding frame mechanism in the well-known manner. The convertible top with its coated convertible window is then transported to the auto dealer 34 and sold to the customer by the dealer at a step 36. According to principles of this invention, the convertible window with its coating 16 remains intact on both faces of the convertible window 17 until the automobile is delivered to the customer, after which the coating can be left in place for a certain period of use followed by removal and reapplication as illustrated at a step 38.

The optically clear, flexible, abrasion-protective film coating 16 preferably comprises a material which adheres to the PVC sheets in dry film form but is inert to PVC in the sense that it does not chemically react with or degrade the PVC film while adhered to both faces of the film. The coating in its dry film form also is water resistant in the sense that washing with water alone (unmodified by any cleaning solutions) or being subjected to rainwater will not readily remove the coating from the window. The coating in dry film form protects the underlying window. The finished coating absorbs a useful level of abrasion damage by itself being scratched, while protecting the underlying PVC film structure from surface scratching. The coating also is semi-permanent in the sense that it can be removed from the window by application of a liquid solution containing an alkaline cleaning agent. In instances where the coating becomes scratched during use and ultimately reduces transparency of the finished window, the coating may be removed and reapplied to continue providing a transparent abrasion-protective window.

A presently preferred coating material is a water-based emulsion containing a polymeric material which can be coated onto the faces of the PVC sheet in liquid form and dried to a thin, flexible, transparent film of uniform thickness adhered to the PVC sheet as a weatherable abrasion-protective film. A presently preferred polymeric material contains an acrylic polymer principally because of its abrasion protection, flexibility, adherence to PVC sheets, and transparency in a dry uniform film thickness. Transparent vinyl and urethane polymers or blends with other similar polymers also may be used. Surprisingly exceptional results are produced by a liquid-based floor polish normally used as a temporary coating for no-wax floors. A material such as the acrylic floor polish sold under the trademark "FUTURE" by S.C. Johnson & Son, Inc. of Racine, Wisconsin is a suitable acrylic-based polymeric film-forming material for the abrasion-protective coating of this invention. Such an acrylic-based material is an emulsion of an acrylic-based polymer which can be diluted by water to the desired viscosity and film-forming consistency. The material is believed to include a surfactant to form the water-based emulsion from the acrylic polymeric material, along with ammonia that can produce a slightly alkaline emulsion. The coating material is wax-free because wax-like components are buffable to a shine which can be greasy or otherwise disrupt the optical transparency of the finished abrasion-protective film.

A preferred process for producing the coating is to use as a starting material the acrylic floor polish which comes from the manufacturer in the same form that it is normally sold to consumers for use as a protective floor polish. This material is then preferably diluted with water to a ratio of about ten parts water to about one part acrylic floor polish, by weight. The PVC sheets are first prewashed in a liquid bath of alcohol and a mild detergent such as a conventional soap for washing glassware. The plastic sheet is then dipped in a liquid solution of a surfactant and alcohol to wash off any plasticizer residue that may be present on the surface of the plastic sheet. A typical surfactant material that can be used in this step is sold under the mark "Witco 918" and is principally used for the purpose of improving surface wetting characteristics for the coating. The PVC sheet is then dipped in the previously diluted solution of acrylic floor polish to coat both sides simultaneously, followed by air drying with a mild air knife for removing excess material. The sheet is then dried in air at an ambient temperature to allow the film to harden to an abrasion-protective transparent flexible coating on both sides of the PVC sheet. Film thickness of the dried coating is about one mil.

The finished dried film produces an abrasion-protective convertible window that resists levels of scratching that normally will cause rejection of an uncoated convertible window made by conventional techniques. An abrasion-protection test to which the window of this invention has been subjected includes use of a nylon scrubbing sponge with a 2½ pound weight applying 20 double strokes to the finished coated sheet. Such an abrasion-protection test revealed that the abrasion-protective coating is scratched only, whereas the coated window, when washed to remove the coating, revealed no scratching of the surface of the underlying PVC sheet.

During use of the convertible window of this invention, normal washing with water will not remove the abrasion-protective coating. Removing the coating can be accomplished by washing it with an alkaline water-based solution containing ammonia and an all-purpose cleaner diluted with water. For instance, the coating can be removed by a solution containing one cup of ammonia, one-fourth cup of all purpose cleaner, and one-half gallon of water.

When the convertible window is first put into use on an automobile by the purchaser, the coated convertible window is left intact and any abrasion that would cause normal scratching of a conventional plastic window will be absorbed by the coating which is preferentially scratched by such abrasion while preventing abrasion of the underlying PVC sheet itself. As scratching from normal abrasion occurs on the coating, its transparency ultimately may be adversely affected to the point where the user may want to remove the coating. The coating can then be removed by the techniques described previously and a new coating of the same acrylic-based coating material can be applied to provide further abrasion protection. Since the coating of this invention is a semi-permanent coating, in the sense that it can be removed when desired and reapplied, the underlying sheet of PVC has its useful life extended significantly, which can provide appreciable savings of labor and materials in the process of manufacturing and installing convertible top windows.

What is claimed is:

1. A process for manufacturing a window for use in a vehicular convertible top, the window being made by the process comprising;

providing a flexible, optically transparent plastic window sheet suitable for use as a vehicular convertible window;

preparing a wax-free liquid coating material comprising an aqueous emulsion of a transparent acrylic polymeric material;

applying the liquid coating material to opposite sides of the plastic sheet; and drying the coating material to a hardened dried film, forming an abrasion-protective coating on opposite faces of the plastic sheet, in which said dried film coating is flexible and optically transparent in its dry thin-film form and adhered to the plastic sheet in its dry form as a semi-permanent coating removable from the plastic sheet by an alkaline aqueous cleaning agent, and in which the dried film coating has a thickness sufficient to prevent abrasion damage to the underlying plastic window sheet.

2. The process according to claim 1 including pre-washing the plastic sheet in a liquid solution containing a surfactant and water to improve film-forming properties and to remove plasticizer residue from the plastic sheet prior to the step of applying the coating.

3. The process according to claim 1 in which the abrasion-protective coating contains a aqueous emulsion containing a surfactant.

4. The process according to claim 1 in which the abrasion-protective coating is removable by an aqueous alkaline cleaning solution comprising ammonia and a cleaning agent.

5. The process according to claim 1 in which the coating in its dry-film form is about one mil thick.

6. The process according to claim 1 in which the dried film coating provides a level of abrasion-damage protection such that scrubbing with a nylon sponge under 2.5 lbs. of weight for 20 strokes does not cause abrasion damage to the underlying plastic window sheet.

* * * * *